US005628367A

United States Patent [19]

Truax et al.

[11] Patent Number: 5,628,367

[45] Date of Patent: May 13, 1997

[54] TEMPERATURE SENSITIVE SPRINKLER HEAD WITH IMPROVED SPRING

[75] Inventors: Perin E. Truax, Caledonia; James G. Retzloff, Lansing, both of Mich.

[73] Assignee: The Viking Corporation, Hastings, Mich.

[21] Appl. No.: 335,645

[22] Filed: Nov. 8, 1994

[51] Int. Cl.[6] ..... A62C 37/14

[52] U.S. Cl. ..... 169/37; 169/38; 169/39

[58] Field of Search ..... 169/37, 38, 39, 169/40, 41, 90

[56] References Cited

U.S. PATENT DOCUMENTS

| | | | |
|---|---|---|---|
| D. 251,128 | 2/1979 | Groos et al. | D23/214 |
| 269,930 | 1/1883 | Harris | 169/41 |
| 600,246 | 3/1898 | Grinnell | 169/37 |
| 873,651 | 12/1907 | Asmus | 169/40 |
| 998,574 | 7/1911 | Hamilton | 169/39 |
| 1,107,845 | 8/1914 | Sackett | 169/37 |
| 1,233,289 | 7/1917 | Thomson | 169/26 |
| 1,736,255 | 11/1929 | Doughty | 169/38 |
| 1,736,256 | 11/1929 | Doughty | 169/37 |
| 1,791,294 | 2/1931 | Ware | 239/222.17 |
| 1,836,528 | 12/1931 | Dyson | 169/37 |
| 1,919,235 | 7/1933 | Loepsinger | 169/39 |
| 2,004,833 | 6/1935 | Rowley | 169/38 |
| 2,076,483 | 4/1937 | Rowley | 239/498 |
| 2,502,754 | 4/1950 | Rowley | 169/38 |
| 2,528,063 | 10/1950 | Loepsinger | 169/38 |
| 3,698,483 | 10/1972 | Martin et al. | 169/37 |
| 3,776,472 | 12/1973 | Lock et al. | 239/591 |
| 3,802,510 | 4/1974 | Johnson | 169/19 |
| 3,904,126 | 9/1975 | Allard | 239/502 |
| 3,911,940 | 10/1975 | Johnson | 137/79 |
| 3,918,645 | 11/1975 | Mohler | 239/498 |
| 3,924,687 | 12/1975 | Groos | 169/19 |
| 4,108,419 | 8/1978 | Sturman et al. | 251/30.05 |
| 4,109,727 | 8/1978 | Job | 169/41 |
| 4,134,759 | 1/1979 | Yajima et al. | 419/17 |
| 4,136,740 | 1/1979 | Groos et al. | 169/39 |
| 4,167,974 | 9/1979 | Job | 169/38 |
| 4,217,961 | 8/1980 | Wotton | 169/41 |
| 4,417,626 | 11/1983 | Hansen | 169/37 |
| 4,494,701 | 1/1985 | Hensley et al. | 239/585.4 |
| 4,570,720 | 2/1986 | Retzloff et al. | 169/39 |
| 4,623,023 | 11/1986 | Retzloff et al. | 169/39 |
| 4,630,682 | 12/1986 | Pieczykolan | 169/38 |

(List continued on next page.)

FOREIGN PATENT DOCUMENTS

| | | | |
|---|---|---|---|
| 413606 | 12/1966 | Switzerland . | |
| 3032 | of 1888 | United Kingdom | 169/41 |
| 765125 | 1/1957 | United Kingdom | 169/37 |

OTHER PUBLICATIONS

*Metals Handbook*, 9th Edition, vol. 6, on welding, brazing, and soldering, published by the American Society of Metals, copyright 1983, "Percussion Welding", pp. 740–742.

*Primary Examiner*—Andrew C. Pike

*Attorney, Agent, or Firm*—Van Dyke, Gardner, Linn & Burkhart, LLP

[57] ABSTRACT

A sprinkler head includes a powdered metal base including external threads for threadably engaging a water pipe, and a stamped metal frame attached to the base. The base defines a passageway for receiving water from the water pipe and an opening to the passageway. The powdered metal base is infiltrated with copper or vacuum infiltrated anaerobic resin to provide a hydrostatically leak tight composition capable of withstanding 700 psi. A deflector is attached to the frame for distributing water dispensed from the opening. A circular plate or circular spring sealingly covers the opening, and a pip is engaged with the frame creating a space therebetween. A frangible bulb is positioned in the space between the Belleville spring. The frangible bulb is made of a temperature-sensitive material that fractures at a predetermined temperature and thus allows water pressure from water in the water pipe to unseat the spring and thus spray water. A capacitor discharge weld is shown for connecting the frame to the base and for connecting the base to the pip so that the frangible bulb is retained with a predetermined force despite dimensional variation in the frangible bulb.

30 Claims, 4 Drawing Sheets

U.S. PATENT DOCUMENTS

| | | | |
|---|---|---|---|
| 4,836,291 | 6/1989 | Owens et al. | 169/46 |
| 4,898,246 | 2/1990 | Riedle et al. | 169/38 |
| 4,981,179 | 1/1991 | Klein | 169/38 |
| 4,993,496 | 2/1991 | Riedle et al. | 169/38 |
| 5,010,959 | 4/1991 | Lostoski | 169/37 |
| 5,020,601 | 6/1991 | Retzloff et al. | 169/37 |
| 5,094,298 | 3/1992 | Polan | 169/41 |
| 5,195,592 | 3/1993 | Simons | 169/37 |

TEMPERATURE SENSITIVE SPRINKLER HEAD WITH IMPROVED SPRING

BACKGROUND OF THE INVENTION

The present invention concerns sprinkler heads for fire extinguisher systems for buildings and the like, and more particularly concerns a sprinkler head configured to facilitate assembly and reduce manufacturing costs.

Sprinkler heads are used in fire extinguisher systems for buildings to automatically dispense water droplets in case of a fire. Historically, the sprinkler heads include a solid metal base connected to a pressurized supply of water, and a frangible bulb for holding a seal over a water outlet in the base. The frangible bulb breaks when it senses a predetermined temperature, thus allowing water from the pressurized source of water to push away the seal and flow from the base onto the fire. The base is typically carefully machined to minimize dimensional variation and irregularities on the base so that the frangible bulb is not over-stressed or unevenly stressed by engagement with the base after assembly, which stresses can cause the frangible bulb to prematurely fail. However, the frangible bulb includes dimensional variations making it difficult to adequately control assembly tolerances even if the dimensional variation in the base is controlled. One solution to this problem is to include a bulb-supporting adjustment screw on the base or on an integral frame supported on the base so that dimensional variation in the frangible bulb and in the base can be taken up by the adjustment screw. For example, see FIG. 1 in the attached drawings. However, the adjustment screw and the structure on the base for receiving same add cost and complexity to the sprinkler head. Further, machining the base adds costly additional manufacturing steps, and results in scrap material and waste during the machining process.

Many known sprinkler heads include individual parts that are chrome-plated or otherwise surface treated to prevent corrosion and/or improve appearance. However, attachment of one part to another by standard welding techniques disrupts the chrome plating or other commonly used surface treatments such that the parts are again subject to corrosion after assembly by welding. More expensive noncorroding materials can be used; however, even if the additional cost is justifiable, standard welding techniques may adversely affect the appearance of these parts.

Thus, a sprinkler head solving the aforementioned problems is desired.

SUMMARY OF THE INVENTION

The present invention includes a sprinkler head for a fire extinguisher system. The sprinkler head includes a base adapted for connection to a pressurized source of water and a frame attached to the base, one of the base and the frame comprising powdered metal. A deflector is attached to the frame for distributing water flowing out of the base. The base defines a passageway and an opening to the passageway for dispensing water, and a temperature-sensitive structure covers the opening and is supported against the base by the frame. The temperature-sensitive structure includes a member configured to yield upon sensing to a predetermined temperature such that, when the predetermined temperature is sensed, the temperature-sensitive structure yields and is pushed away by water from the pressurized source of water, which water is then dispensed through the opening.

These and other features and advantages of the present invention will be further understood and appreciated by those skilled in the art by reference to the following specification, claims, and appended drawings.

DESCRIPTION OF PRIOR ART SPRINKLER HEAD

Figure 1:
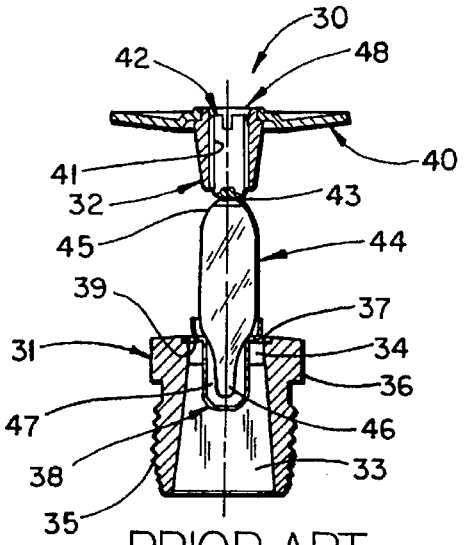
PRIOR ART FIG.1
FIG. 1 is a side cross-sectional view of a sprinkler head in prior art.

A prior art sprinkler head 30 (FIG. 1) includes a solid metal base 31, such as brass, including an integral cast-in-place U-shaped arch or frame 32. A passageway 33 is formed in the base 31, and the frame 32 arches over the outlet opening 34 of the passageway 33. Threads 35 are machined onto the exterior of base 31 for threadably engaging a pressurized source of water, and a shoulder 36 is provided for engagement by a wrench to turn base 31 into the source of water. A ring-shaped recess 37 is machined into base 31 at outlet opening 34, and a cup-shaped member 38 including a ring-shaped seal 39 fits mateably over outlet opening 34 with seal 39 sealingly engaging ring-shaped recess 37. A deflector 40 is attached to frame 32 for deflecting water flowing out of opening 34 into an optimal pattern. A threaded hole 41 is formed in frame 32 generally over outlet opening 34, and a screw 42 including an end having a pocket 43 therein is extended through the hole 41. A frangible bulb 44 is positioned between cup-shaped member 38 and screw 42. Bulb 44 is manufactured by ways generally known in the art. The bulb 44 includes a rounded end 45 that mateably engages the pocket 43 in screw 42 and further includes an irregular end 46 that mateably extends into the space 47 within cup-shaped member 38. By adjusting screw 42, the amount of compression on bulb 44 can be adjusted to a predetermined level. An anaerobic adhesive 48 fills threaded hole 41 to prevent movement of screw 42 once the compressive force on bulb 44 is set adjusted to a desired amount.

DETAILED DESCRIPTION OF PREFERRED EMBODIMENTS

A sprinkler head 50 (FIGS. 2–3) embodying the present invention includes a powdered metal base 51 adapted for connection to a pressurized source of water, such as a water pipe or nipple extending from a water pipe. A U-shaped stamped-metal frame 52 is fixedly secured to the base 51. Base 51 defines a passageway 54, and a temperature-sensitive structure 53 is positioned between the frame 52 and the base 51 over an outlet opening 55 to the passageway 54. The temperature-sensitive structure 53 includes a pip 56 engaging the frame 52, a Belleville spring or circular plate spring or solid disc 57 covering the outlet opening 55, and a frangible bulb 58 held in compression between the pip 56 and the disc 57 for holding the disc 57 over opening 55. When frangible bulb 58 senses a predetermined temperature, it fractures or yields such that the bulb 58 and the disc 57 are pushed away by water from the pressurized source of water, which water is then dispensed through the opening. A deflector 59 attached to frame 52 disperses the water into a predetermined pattern of droplets for dousing any fire below the sprinkler head 50. Notably, sprinkler head 50 comprises an assembly of components 51, 52, 56, 57, 58, and 59 which facilitate connection, reduce manufacturing cost, and improve the consistency of assembly by their composition and also by their interconnection, as discussed below.

Base 51 (FIG. 3) comprises a ferrous or ferrous alloy powdered metal having a corrosion resistant finish, infiltrated by one of copper or anaerobic resin to make it substantially impervious to water. It is contemplated that the infiltration is accomplished by a heat process that wicks the filling material by capillary physics or by vacuum into the powdered metal. The infiltrated powdered metal base is substantially impervious at 700 psi of water pressure. By producing base 51 from powdered metal, base 51 can be formed in substantially a net final shape, except for a few finishing operations such as forming threads 62, as discussed below. This reduces secondary operations required in manufacturing, and further reduces the scrap generated by material machined from the base 51.

An unfinished base piece 51' that can be used to make base 51 is shown in FIGS. 4–7 after it is formed but before machining the pipe threads 62 (FIG. 3) onto the exterior surface of the inlet end of section 60. As originally formed, base piece 51' includes an inlet end section 60 and an outlet end section 61. The passageway 54 extends axially through end section 60 and 61. Inlet end section 60 includes a cylindrically shaped wall 62'. A ring-shaped recess or seat 63 (FIGS. 4–7) is formed at outlet opening 55 for mateably sealingly receiving the disc 57. An oblong flange 64 extends around the exterior of outlet end section 61 such that it provides structure for engagement by a wrench to rotate base 51 into sealing engagement with the pressurized source of water. A pair of opposing slots 65 are formed in the outermost edges of oblong flange 64 for mateably receiving arms 66 on frame 52. Also, a trade name, indicia, or other imprinted information can be included on base 51, such as at location 67.

The illustrated frame 52 (FIG. 3) comprises a stamped metal U-shaped part, although it is contemplated that frame 52 could also be made from powdered metal or injection formed materials. It is contemplated that frame 52 will be a chrome-plated or painted ferrous material, although various materials will work satisfactorily. Frame 52 includes a configured center section or arch 68 from which arms 66 extend. Arms 66 have a length and thickness chosen to mateably slideably engage and substantially fill slots 65 on base 51. The ends 69 of arms 66 include a notch 70 defining a laterally-extending surface 71 for abuttingly engaging the outlet end surface 72 of base 51. A pip-receiving notch 73 is formed in the underside of arch 68. The distance D 1 from the laterally-extending surface 74 on pip-receiving notch 73 and the laterally extending surface 71 on arms 66 plus the thickness of ring-shaped recess 63 defines a space for receiving temperature-sensitive structure 53. This dimension is important since frangible bulb 58, which is part of temperature-sensitive structure 53, is sensitive to overpressure or nonuniform pressure. Specifically, overpressure or other undesirable stress can cause premature failure of bulb 58, causing unnecessary water damage to goods and products being safe-guarded by sprinkler head 50.

Figure 8:
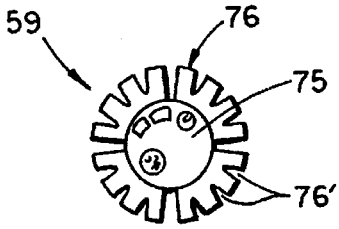
FIG. 8 is a plan view of the deflector shown in FIG. 3.
Figure 9:
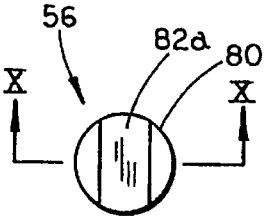
FIG. 9 is a top view of the pip shown in FIG. 3.
Figure 10:
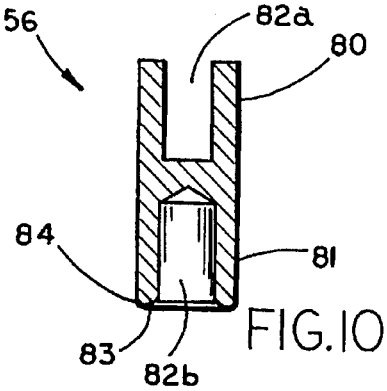
FIG. 10 is a cross-sectional view taken along the lines X—X in FIG. 9.
Figure 11:
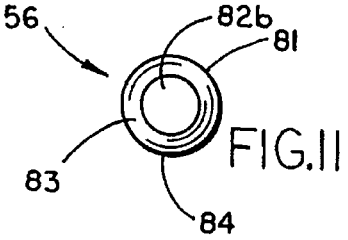
FIG. 11 is a bottom view of the pip shown in FIG. 9.
Figure 12:
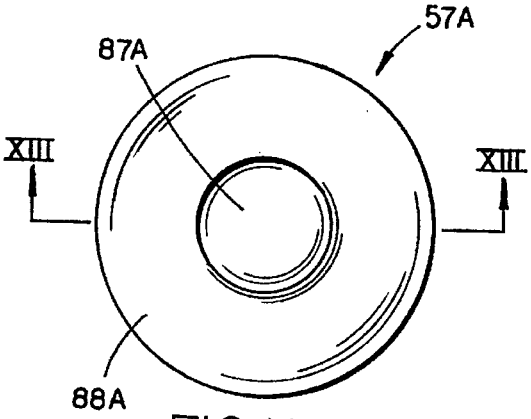
FIG. 12 is a plan view of a modified Belleville spring that could be used in place of the disc in FIG. 3.
Figure 13:
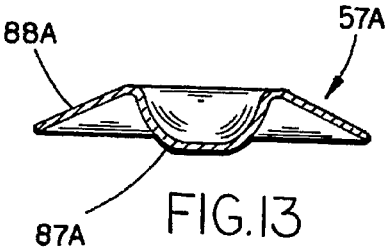
FIG. 13 is a side cross-sectional view taken along the lines XIII—XIII in FIG. 12.

Deflector 59 (FIGS. 2–3 and 8) is dish-shaped, and includes a center section 75 and a radially notched section 76 including notches 76' that extend radially from center section 75. The details and importance of construction of deflector 59 are generally known in the art and need not be repeated herein. It is sufficient to note that deflector 59 is particularly designed to create an optimal distribution of water droplets and water droplet sizes for dousing a fire.

Figure 2:
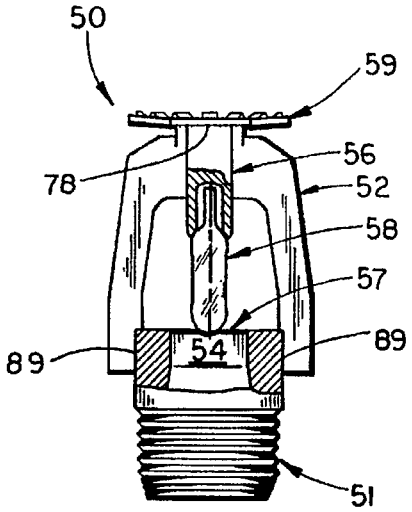
FIG. 2 is a partially broken away side view of a sprinkler head embodying the present invention.
Figure 3:
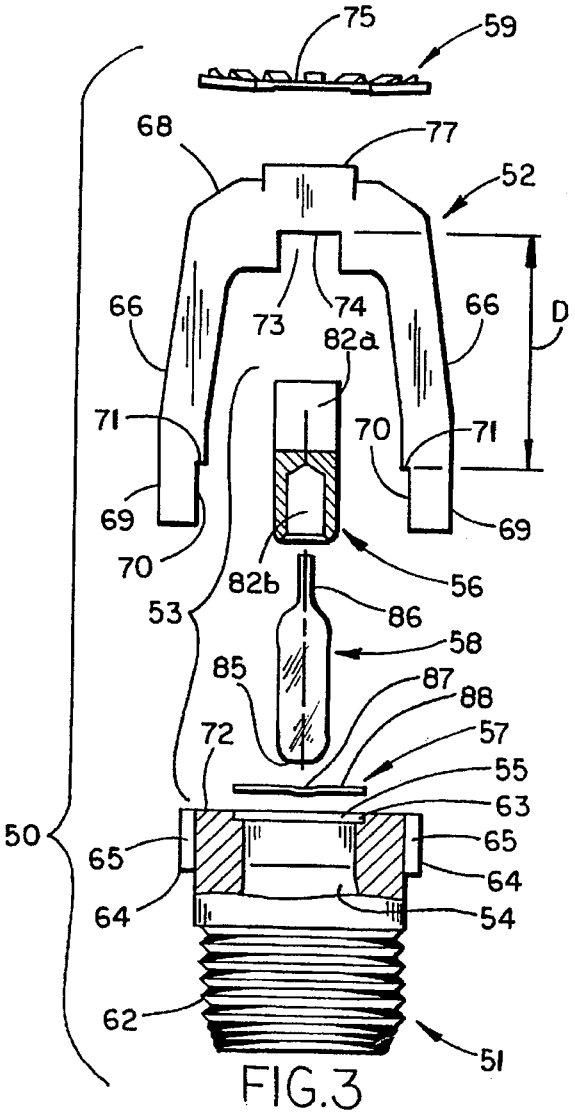
FIG. 3 is an exploded side view of the sprinkler head shown in FIG. 2.
Figure 4:
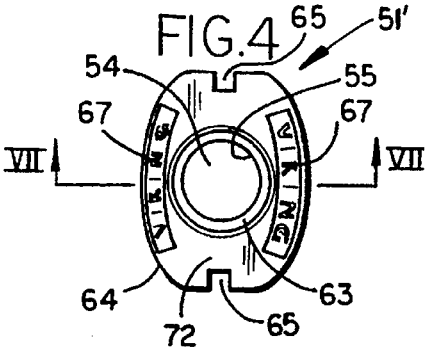
FIG. 4 is a top view of the sprinkler head base shown in FIG. 3.
Figure 5:
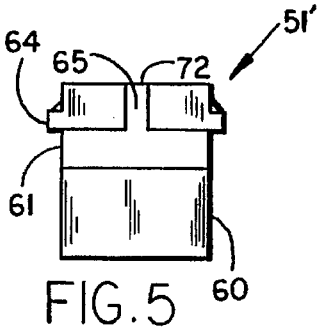
FIG. 5 is a side view of the base shown in FIG. 4.
Figure 6:
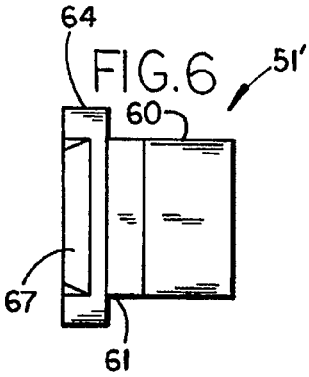
FIG. 6 is another side view of the base shown in FIG. 4.
Figure 7:
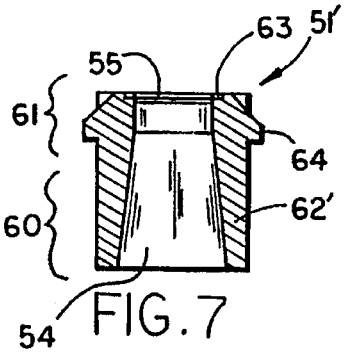
FIG. 7 is a cross-sectional view taken along the lines VII—VII in FIG. 4.

A protrusion 77 extends from arch 68 of flame 52 for supporting deflector 59. Deflector 59 is secured to protrusion 77 by a process including capacitor discharge welding. Capacitor discharge welding is particularly advantageous since the welding energy is locally focused in order to minimize surface disruption on the frame 52 and the deflector 59 proximate the joint 78 created (FIG. 2). This is important since disruption to a surface creates gaps in the corrosion-resistant coating or plating on the frame 52 and deflector 59. In particular, by using capacitor discharge welding, the flame 52 and deflector 59 can be made of preplate ferrous parts, which reduces manufacturing costs. The slug of weld material formed by capacitor discharge welding is substantially confined to the region of the connecting material at joint 78 joining the frame 52 and the deflector 59. Notably, since the surface proximate joint 78 is not disrupted, the appearance of the components that are capacitor discharge welded is also not adversely affected. It is noted that joint 78 may also secure pip 56 to deflector 59 and frame 52, depending on the length of pip 56, as discussed below.

Pip 56 (FIGS. 3 and 9–11) is rod-shaped, and is configured for manufacture on a screw machine or the like. Alternatively, it is contemplated that the pip can be stamped from sheet metal and machined, or made by other manufacturing methods. Pip 56 includes a flame-engaging end section 80 and a bulb-engaging end section 81. Frame-engaging end section 80 includes a slot **82*a* extending axially into pip 56. Slot 82*a* has the width equal to the thickness of frame arch 68. Notably, slot 73 on frame arch 68 has a width about equal to the diameter of pip 56. Thus, pip 56 is configured to slideably engage arch 68 and be securely retained therein. The bulb-engaging end section 81 of pip 56 includes a relatively deep recess 82*b* for receiving an end of bulb 58. The end surface 83 of bulb-engaging end section 81 is radiused so that it securely and mateably engages and supports the bulb 58. The outer radius 84 of end surface 83 is also important in that the radius 84 causes water flowing out of outlet opening 55 to wrap around the pip 56 due to surface tension in the water. This results in a more efficient utilization of deflector 59, a smaller deflector 59**, and a more desirable water droplet pattern.

Frangible bulb 58 (FIG. 3) comprises a hollow glass material filled with a liquid material designed to fracture at a predetermined temperature. For instance, an exemplary predetermined temperature is 135° F. The compositions of these components and the processes for manufacturing same are generally known in the art and need not be described in detail herein. However, it is noted that the longitudinal dimensional variation in frangible bulb 58 in as much as 0.040 inches. The frangible bulb 58 includes a rounded, smooth end 85 and an irregular end 86. In known prior art, the irregular end was typically oriented toward the base, such as is shown in the prior art sprinkler head 30 shown in FIG. 1. However, the present sprinkler head 50 orients the frangible bulb 58 so that the smooth end 85 is oriented toward the base 51 and the irregular end 86 is oriented toward the pip 56. This arrangement facilitates assembly and eliminates the compression screw used in prior art sprinkler heads, such as the exemplary compression screw 42 shown in FIG. 1. Further, the arrangement tends to reduce the heat transfer from the bulb 58 to the water in the passageway 54 of base 51 by moving bulb 58 generally farther away from water in passageway 54, and thus provides a desirable, temperature responsive arrangement. Notably, this orientation eliminates compression screw 42 of FIG. 1.

Belleville spring 57 (FIGS. 2–3) is a solid disc having a radius chosen to mateably fit within and sealingly engage recess 63 of outlet opening 55 in base 51. Spring 57 includes a center section 87 that is deformed to mateably receive the smooth end 85 of bulb 58. Spring 57 includes a laterally extending ring-shaped flange 88 that provides a predetermined spring constant and a desired level of resiliency.

Sprinkler head 50 (FIGS. 2–3) is assembled by positioning pip 56 on frame 52 with pip notch 73 engaging frame arch 68, by positioning Belleville spring 57 in recess 63, and by loosely positioning frangible bulb 58 therebetween with the smooth end 85 of bulb 58 extending toward spring 57. Frame 52 is then moved into engagement with base 51 until frame arms 66 slideably engage base slots 65. Once frame laterally extending surface 71 engages the end surface 72, the frame 52 is capacitor discharge welded into a final position at location 89. Alternatively, it is noted that frame 52 can be moved into engagement with base 51 until bulb 58 is retained between frame 52 and base 51 with a predetermined level of compressive force (FIG. 24), at which time the assembly would be capacitor discharge welded into position. The advantages of capacitor discharge welding were previously mentioned above, such as reduced surface disruption and hence continued corrosion resistance of any surface treatment thereon, improved appearance after welding, and a weld nugget substantially localized and confined to the welded area. Most notably, the weld allows for the bulb variance of 0.040 inches.

Further embodiments are shown in FIGS. 12–23. In these embodiment, comparable and identical features are labelled with identical numbers, but with the addition of the letters "A", "B", "C", "D", and "E".

A modified solid disc 57A (FIGS. 12–13) includes a deformed center section 87A and an angled radially extending flange 88A. Disc 57A provides a different spring constant than the Belleville spring/disc 57 (FIG. 2) and further is flexible over a greater distance than disc 57.

Figure 14:
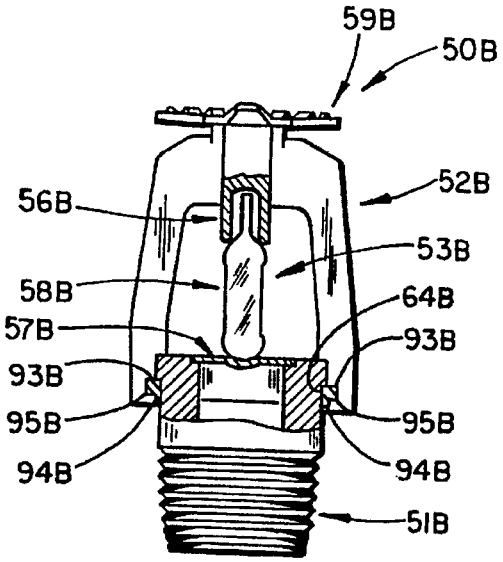
FIG. 14 is a partially broken away side view of a modified sprinkler head embodying the present invention.
Figure 16:
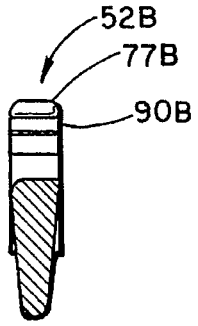
FIG. 16 is a cross-sectional view taken along the lines XVI—XVI in FIG. 15.
Figure 17:
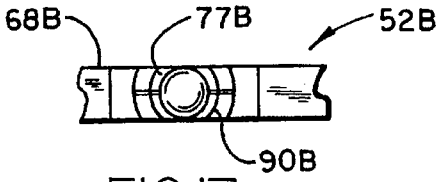
FIG. 17 is a fragmentary top view of the frame shown in FIG. 15.
Figure 15:
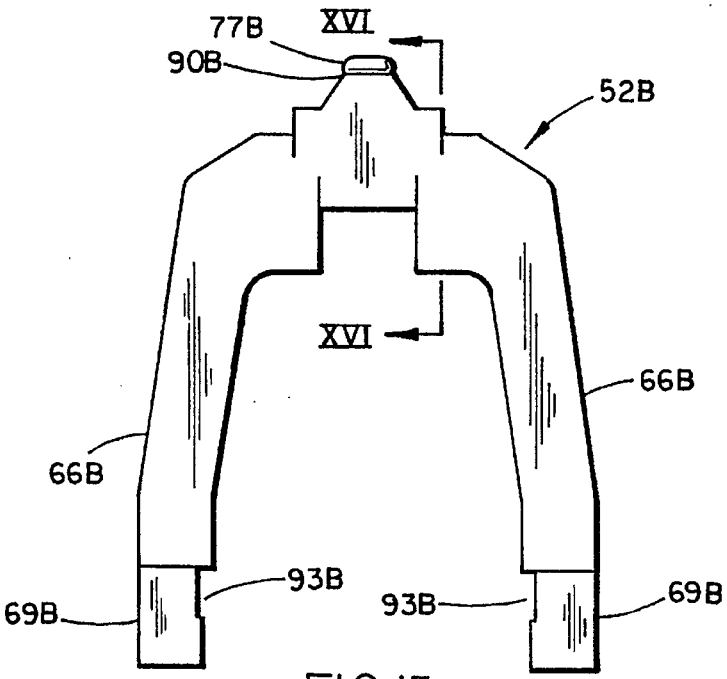
FIG. 15 is a side view of the frame shown in FIG. 14.
Figure 18:
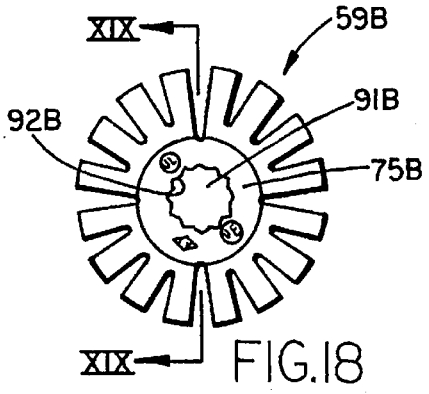
FIG. 18 is a plan view of the deflector shown in FIG. 14.
Figure 19:
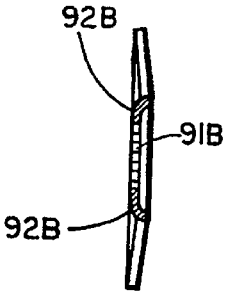
FIG. 19 is a cross-sectional view taken along the lines XIX—XIX in FIG. 18.
Figure 21:
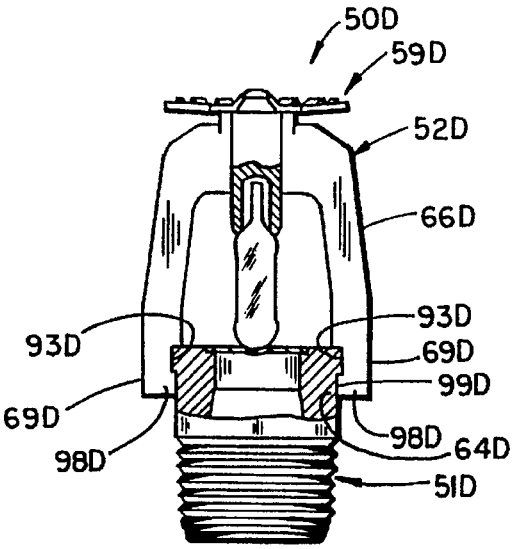
FIG. 21 is a partially broken away side view of another modified sprinkler head embodying the present invention.
Figure 20:
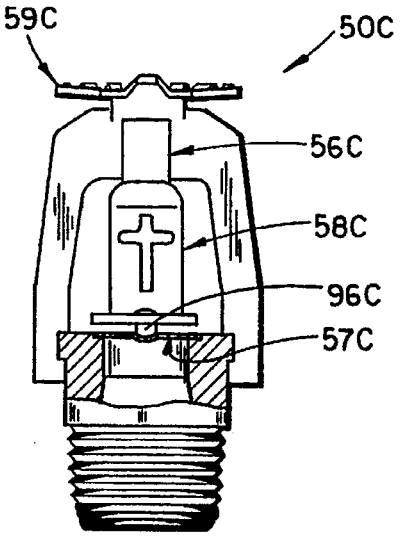
FIG. 20 is another partially broken away side view of a modified sprinkler head embodying the present invention.

A modified sprinkler head 50B (FIG. 14) includes a powdered metal base 51B, a modified stamped frame 52B, a modified deflector 59B, and a temperature-sensitive structure 53B, temperature-sensitive structure 53B further including a pip 56B, a disc 57B, and a frangible bulb 58B. Frame 52B includes a modified protrusion 77B defining an undercut lip 90B (FIGS. 15–17). Deflector 59B (FIG. 18) includes a geometrically shaped aperture 91B in center section 75B. A plurality of small fingers 92B extend at an angle into aperture 91B. Fingers 92B are configured to snap lock onto undercut lip 90B. Alternatively, fingers 92B can be deformed into interlocking engagement with undercut lip 90B.

The ends 69B of frame arms 66B are also modified to include a pair of laterally facing inner notches 93B (FIG. 15). A pair of undercuts or notches 94B (FIG. 14) are/brined in base flange 64B that correspond to frame notches 93B. As shown in FIG. 14, when assembled, notches 93B and 94B define spaces therebetween. After assembling frame 52B onto base 51B to a predetermined level of compression on bulb 58B (see FIG. 24), an interlocking key 95B (FIG. 14) is injected into spaces to secured frame 52B at the predetermined desired position. It is contemplated that the interlocking key 95B will be a zinc material, although alternative materials can be used. Notably, sprinkler head 50B can be assembled without the need for a welding operation.

Sprinkler head 50C (FIG. 20) includes a modified temperature-sensitive structure (53). In particular, the frangible bulb (58) is replaced with a temperature sensitive member or fusible link 58C made of an alloy material that characteristically melts, deforms, and/or fractures at a predetermined temperature. The fusible link material is known in prior art, and need not be described in detail for an understanding of the present invention. Pip 56C is modified to mateably engage alloy member 58C. Alternatively, alloy member 58C could be modified to incorporate pip 56C; however it is noted that the surface (see radius 84 in FIG. 10) exposed when alloy member 58C fractures should be designed to cause water to wrap around the surface into engagement with deflector 59C. Also, the bottom surface of fusible link 58C is modified to include a thermally insulating centered standoff 96C for engaging disc 57C. This arrangement eliminates the 0.040 inch bulb variances allowing for a consistent predetermined length snap-fit assembly. Thus, welding, injecting, or staking costs and operations are eliminated.

Figure 22:
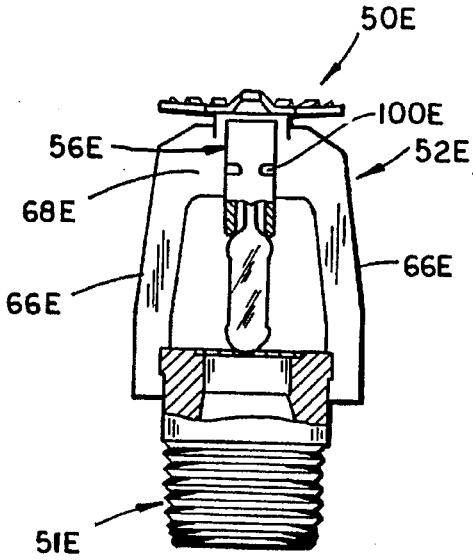
FIG. 22 is a partially broken away side view of yet another modified sprinkler head embodying the present invention.

A sprinkler head 50D (FIG. 21) includes a modified base 51D and a modified frame 52D configured to snap-lock onto base 51D. Specifically, the ends 69D of frame arms 66D are modified to include a pair of laterally facing inner notches 93D and associated tabs 98D. A pair of notches 99D are formed in base flange 64D that correspond to frame notches 93D. Frame arms 66D are configured to resiliently flex apart as frame 52D is assembled to base 51D. As shown in FIG. 22, when frame 52D is assembled to base 51D, tabs 98D fit into notches 99D. Since the deflector 59D is also assembled to frame 52D without welding, the sprinkler head 50D can be assembled without the need for a welding operation.

Figure 23:
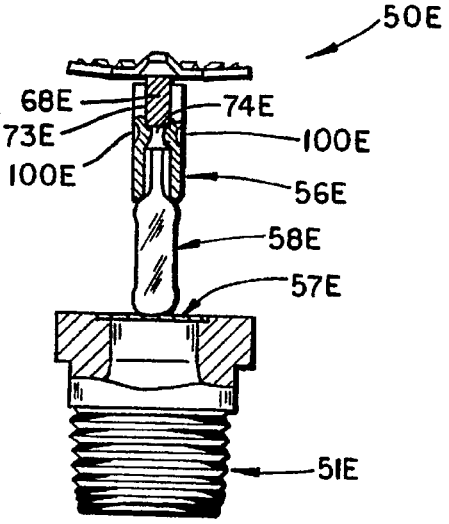
FIG. 23 is a partially broken away side view of the sprinkler head in FIG. 22, FIG. 23 being rotated 90° from the position of FIG. 22.
Figure 24:
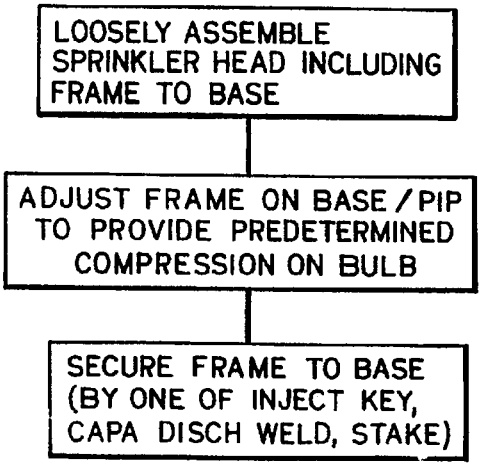
FIG. 24 is a schematic of a method of assembling a sprinkler head.

A sprinkler head 50E (FIGS. 22–23) includes a modified pip 56E adapted to slideably engage frame arch 68E. Frame 52E is assembled to base 51E with pip 56E, bulb 58E, and disc 57E loosely held therebetween (FIG. 24). Notably, the bulb 58E is loosely held therein since pip 56E slideably engages frame 52E (FIGS. 22–23). Once loosely assembled, pip 56E is further moved relative to frame arch 68E so that bulb 58E is compressed against disc 57E with a desired predetermined amount of compressive force. The sides of pip 56E are then staked resulting in deformed material 100E. Deformed material 100E frictionally engages the sides of frame arch 68E and abuttingly engages surface 74E of pip receiving notch 73E to retain pip 56E in the desired position and to maintain the predetermined amount of compressive force on bulb 58E. Frame arms 66E snap-lock onto base 51E in an identical manner to frame 52D and base 51D, although it is noted that alternative constructions can be used, such as the illustrated sprinkler head 50B or other known sprinkler head constructions.

Thus, sprinkler heads are provided that reduce part cost and that facilitate assembly. The powdered metal base is substantially complete as formed, and requires minimal secondary processing. The stamped frame can be assembled and secured to the base by any of several novel connections including capacitor discharge welding, snap-lock attachment, or by use of injected interlocking keys. The disc, pip, and bulb provide a low number of parts that can be readily assembled. The compression on the bulb can be readily controlled. In one form, the pip is adjusted on and then staked to the frame to hold a predetermined compression on the bulb.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A sprinkler head for a fire extinguisher system, said sprinkler head comprising:

a base adapted for connection to a source of water, said base defining a passageway and an opening to said passageway, said base including opposite sides having a corrosion-resistant finish thereon;

a substantially flat plate spring sealing and covering said opening;

a U-shaped frame including arms configured to slidably engage said opposite sides of said base, said arms also including a corrosion-resistant finish thereon, said arms of said U-shaped frame being secured to said base by a capacitor discharge weld, the corrosion-resistant finish of said opposite sides and said arms being substantially undisturbed by said capacitor discharge weld; and a temperature-sensitive member contacting said substantially flat plate spring and being captured between said frame and said substantially flat plate spring to hold said substantially flat plate spring over said opening, said temperature-sensitive member being configured to yield upon sensing a predetermined temperature such that, when said predetermined temperature is sensed, said temperature-sensitive member yields and thus releases said substantially flat plate spring from said base to uncover said opening.

2. A sprinkler head as defined in claim 1 wherein said temperature-sensitive member comprises a frangible bulb.

3. A sprinkler head as defined in claim 1 further comprising a temperature-sensitive member support having a slotted end slidably mating with said frame, said temperature-sensitive member extending between said temperature-sensitive member support and said spring.

4. A sprinkler head for a fire extinguisher system, said sprinkler head comprising:

a base adapted for connection to a pressurized source of water, said base defining a passageway and an opening to said passageway and including opposite slots;

a frame attached to said base, said frame including opposite arms configured to mateably and slidably engage said opposite slots of said base;

a spring sealing said opening;

a deflector attached to said frame for distributing water flowing out of said opening; and a temperature-sensitive member in bearing contact with said spring, said temperature-sensitive member being configured to yield upon sensing a predetermined temperature such that when said predetermined temperature is sensed, said temperature-sensitive member yields and is pushed away by the water from the pressurized source of water pushing on said spring, which water is then dispensed through said opening.

5. A sprinkler head as defined in claim 4 wherein said temperature-sensitive member comprises a frangible bulb.

6. A sprinkler head as defined in claim 4 wherein one of said base and said frame is comprised of powdered metal.

7. A sprinkler head as defined in claim 4 further comprising a temperature-sensitive member support having a slotted end slidably mating with said frame, said temperature-sensitive member extending between said temperature-sensitive member support and said spring.

8. A sprinkler head as defined in claim 4 wherein said spring comprises a solid circular plate spring positioned over said opening of said base, said solid circular plate spring contacting and engaging said base and covering and sealing said opening.

9. A sprinkler head for a fire extinguisher system, said sprinkler head comprising:

a base adapted for connection to a pressurized source of water, said base defining a passageway and an opening to said passageway and including opposite slots;

a frame attached to said base, said frame including opposite arms configured to mateably and slidably engage said slots of said base, one of said base and said frame being comprised of powdered metal;

a solid disc spring selectively covering and sealing said opening;

a deflector attached to said frame for distributing water flowing out of said opening; and a temperature-sensitive member in bearing contact with said solid disc spring, said member being configured to yield upon sensing a predetermined temperature such that when said predetermined temperature is sensed, said temperature-sensitive member yields and is pushed away by the water from the pressurized source of water pushing on said solid disc spring, which water is then dispensed through said opening, whereby said solid disc spring operates both as a spring for said temperature-sensitive member and as a closure for said opening.

10. A sprinkler head for a fire extinguisher system, said sprinkler head comprising:

a base adapted for connection to a pressurized source of water, said base defining a passageway and an opening to said passageway;

a frame attached to said base;

a spring sealing said opening of said base;

a deflector attached to said frame for distributing water flowing out of said opening;

a temperature-sensitive member holding said spring on said base to seal said opening; and a temperature-sensitive member support having a slotted end slidably mating with said frame, said temperature-sensitive member extending between said temperature-sensitive member support and said spring and being configured to yield upon sensing a predetermined temperature such that when said predetermined temperature is sensed, said temperature-sensitive member yields and is pushed away by the water from the pressurized source of water pushing on said spring, which water is then dispensed through said opening.

11. A sprinkler head as defined in claim 10 wherein said temperature-sensitive member comprises a frangible bulb.

12. A sprinkler head as defined in claim 10 wherein one of said base and said frame is comprised of powdered metal.

13. A sprinkler head as defined in claim 10 wherein one of said base and said deflector is secured to said frame by a capacitor discharge weld.

14. A sprinkler head as defined in claim 10 wherein said spring comprises a solid circular plate spring positioned over said opening of said base, said solid circular plate spring contacting and engaging said base and covering and sealing said opening.

15. A sprinkler head for a fire extinguisher system, said sprinkler head comprising:

a base adapted for connection to a pressurized source of water, said base defining a passageway and an outlet opening for said passageway;

a frame attached to said base;

a deflector attached to said frame for dispersing water flowing from said outlet opening;

a pip slidably engaged with said frame, said pip including a first bulb-engaging surface and a slotted end for mateably engaging said frame;

a solid circular plate spring positioned over said outlet opening of said base, said solid circular plate spring contacting and engaging said base and sealing said outlet opening, said solid circular plate spring including a second bulb-engaging surface; and an inverted frangible bulb including an irregular end engaging said first bulb-engaging surface of said pip and a rounded end engaging said second bulb-engaging surface of said solid circular plate spring fur holding said solid circular plate spring against said outlet opening, said frangible bulb being configured to fracture upon sensing a predetermined temperature such that, when said predetermined temperature is sensed, said frangible bulb fractures and is pushed away by the water from the pressurized source of water, which water is then dispensed through the outlet opening and distributed by said deflector.

16. A sprinkler head as defined in claim 15 wherein said circular plate spring comprises a Belleville spring.

17. A sprinkler head as defined in claim 15 wherein said circular plate spring includes a deformed section for mateably receiving said rounded end of said inverted frangible bulb, said circular plate spring being continuous and impervious such that water cannot pass through said circular plate spring.

18. A sprinkler head as defined in claim 15 wherein said pip includes a recess configured to receive said irregular end of said bulb.

19. A sprinkler head as defined in claim 15 wherein one of said base and said frame is comprised of powdered metal.

20. A sprinkler head as defined in claim 15 wherein one of said base and said deflector is secured to said frame by a capacitor discharge weld.

21. A sprinkler head for a fire extinguisher system, said sprinkler head comprising:

a base adapted for connection to a pressurized source of water, said base defining a passageway and an outlet opening for said passageway;

a frame attached to said base;

a deflector attached to said frame for dispersing water flowing from said outlet opening;

a pip attached to said frame including a first bulb-engaging surface and a slotted end for mateably engaging said frame;

a circular plate spring sealingly covering said opening and including a second bulb-engaging surface; and an inverted frangible bulb including an irregular end engaging said first bulb-engaging surface of said pip and a rounded end engaging said second bulb-engaging surface of said circular plate spring for holding said circular plate spring against said outlet opening, said frangible bulb being configured to fracture upon sensing a predetermined temperature such that, when said predetermined temperature is sensed, said frangible bulb fractures and is pushed away by the water from the pressurized source of water, which water is then dispensed through the outlet opening and distributed by said deflector.

22. A sprinkler head for a fire extinguisher system, said sprinkler head comprising:

a base adapted for connecting to a source of water, said base defining a passageway for receiving the water from the source of water and an opening to dispense the water;

a frame attached to said base, said frame defining an arch over the opening;

a deflector attached to said frame for distributing the water dispensed from the opening;

a solid disc sealingly engaging the opening;

a frangible bulb engaging said disc to keep said disc in place against said opening despite water pressure from the source of water; and a pip mateably engaging said bulb and including a slotted end mateably engaging said frame, said frame being configured to slidably engage one of said base and said pip, and further being configured to be fixedly secured to said one of said base and said pip in an adjusted position, whereby despite normal dimensional variation when manufacturing a plurality of frangible bulbs, said frame and said pip can be adjusted to hold said disc against the opening with a predetermined pressure to prevent leakage of water but so that said frangible bulb engaging said disc does not prematurely fail.

23. A sprinkler head as defined in claim 22 wherein said base comprises powdered metal.

24. A sprinkler head for a fire extinguisher system, said sprinkler head comprising:

a base adapted for connection to a pressurized source of water, said base defining a passageway and an opening to said passageway;

a frame attached to said base, one of said base and said frame being comprised of powdered metal;

a solid disc spring selectively covering and sealing said opening of said base;

a deflector attached to said frame for distributing water flowing out of said opening; and a temperature-sensitive member in bearing contact with said solid disc spring, said temperature-sensitive member including a pip for engaging said frame and a frangible bulb positioned between said pip and said solid disc spring for mateably engaging said pip and said solid disc spring, said pip including a slotted end for mateably engaging said frame, said temperature-sensitive member being configured to yield upon sensing a predetermined temperature such that when said predetermined temperature is sensed, said temperature-sensitive member yields and is pushed away by the water from the pressurized source of water pushing on said solid disc spring, which water is then dispensed through said opening, whereby said solid disc spring operates both as a spring for said temperature-sensitive member and as a closure for said opening.

25. A sprinkler head for a fire extinguisher system, said sprinkler head comprising:

a base adapted for connection to a pressurized source of water, said base defining a passageway and an opening to said passageway;

a frame attached to said base, one of said base and said frame being comprised of powdered metal;

a solid disc spring selectively covering and sealing said opening of said base;

a deflector attached to said frame for distributing water flowing out of said opening; and a temperature-sensitive member in bearing contact with said solid disc spring, said temperature-sensitive member including a pip for engaging said frame and a frangible bulb positioned between said pip and said solid disc spring for mateably engaging said pip and said solid disc spring, said solid disc spring including a shallow recess, said pip including a deep recess, said frangible bulb including a rounded end for mateably engaging said shallow recess and an irregular end configured to engage said deep recess, said temperature-sensitive member being configured to yield upon sensing a predetermined temperature such that when said predetermined temperature is sensed, said temperature-sensitive member yields and is pushed away by the water from the pressurized source of water pushing on said solid disc spring, which water is then dispensed through said opening, whereby said solid disc spring operates both as a spring for said temperature-sensitive member and as a closure for said opening.

26. A sprinkler head as defined in claim 25 wherein said base is configured to slideably engage said frame before being fixedly secured thereto.

27. A sprinkler head as defined in claim 25 wherein said pip is configured to slideably and mateably engage said frame before being fixed relative to said frame.

28. A sprinkler head as defined in claim 27 wherein said pip further includes deformed material holding said pip in a fixed position relative to said frame.

29. A sprinkler head for a fire extinguisher system, said sprinkler head comprising:

a base adapted for connection to a pressurized source of water, said base including a passageway and an outlet opening for said passageway;

a frame attached to said base, one of said base and said frame comprising powdered metal, said frame being attached to said base by a capacitor discharge weld;

a deflector attached to said frame for dispersing the water flowing from said outlet opening;

a pip seated against said frame, said pip including a slotted end slidably mating with said frame;

a spring at least partially covering said opening; and an inverted frangible bulb including an irregular end engaging said pip and a rounded end contacting said spring for holding said spring against said base, said frangible bulb being configured to fracture upon sensing a predetermined temperature such that, when said predetermined temperature is sensed, said frangible bulb fractures and is pushed away by the water from the pressurized source of water pushing on said spring, which water is then dispensed through said outlet opening and distributed by said deflector.

30. A sprinkler head for a fire extinguisher system according to claim 29, wherein said spring comprises a plate spring which fully covers and seals said opening.

* * * * *